US011628550B2

(12) United States Patent
Sun

(10) Patent No.: US 11,628,550 B2
(45) Date of Patent: Apr. 18, 2023

(54) VIBRATION REDUCING STRUCTURE OF PNEUMATIC HAMMER

(71) Applicant: STORM PNEUMATIC TOOL CO., LTD., Taichung (TW)

(72) Inventor: Yung Yung Sun, Taichung (TW)

(73) Assignee: STORM PNEUMATIC TOOL CO., LTD., Taichung (TW)

( * ) Notice: Subject to any disclaimer, the term of this patent is extended or adjusted under 35 U.S.C. 154(b) by 17 days.

(21) Appl. No.: 17/533,827

(22) Filed: Nov. 23, 2021

(65) Prior Publication Data

US 2022/0080574 A1 Mar. 17, 2022

Related U.S. Application Data

(63) Continuation-in-part of application No. 16/901,788, filed on Jun. 15, 2020, now abandoned, which is a continuation-in-part of application No. 16/784,770, filed on Feb. 7, 2020, now abandoned.

(51) Int. Cl.

| | |
|---|---|
| ***B25D 9/04*** | (2006.01) |
| ***B25D 9/08*** | (2006.01) |
| ***B25D 17/24*** | (2006.01) |

(52) U.S. Cl.

CPC ..... *B25D 17/24* (2013.01); *B25D 9/04* (2013.01); *B25D 9/08* (2013.01); *B25D 2217/0092* (2013.01); *B25D 2250/181* (2013.01); *B25D 2250/365* (2013.01); *B25D 2250/371* (2013.01)

(58) Field of Classification Search

CPC . B25D 9/04; B25D 9/08; B25D 17/24; B25D 2217/0092; B25D 2250/181; B25D 2250/365; B25D 2250/371

See application file for complete search history.

(56) References Cited

U.S. PATENT DOCUMENTS

| | | | | | |
|---|---|---|---|---|---|
| 1,441,017 | A | * | 1/1923 | Mattson | F03C 1/03 91/279 |
| 2,120,992 | A | * | 6/1938 | Seiden | B25D 9/08 91/335 |
| 2,722,918 | A | * | 11/1955 | Kimball | B25D 9/08 173/121 |
| 2,899,934 | A | | 8/1959 | Sallengro | |
| 2,985,139 | A | | 5/1961 | Powers et al. | |
| 3,352,323 | A | | 11/1967 | Wickham | |
| 3,411,592 | A | | 11/1968 | Montabert | |

(Continued)

*Primary Examiner* — Thomas M Wittenschlaeger
*Assistant Examiner* — David G Shutty
(74) *Attorney, Agent, or Firm* — Muncy, Geissler, Olds & Lowe, P.C.

(57) ABSTRACT

A vibration reducing structure of pneumatic hammer includes a handle having a concave room with a bottom wall and an air inlet channel communicating with the concave room. A control valve is disposed in the air inlet channel. A movable inner tube shell is accommodated in an outer tube shell coupled with the concave room and extends a rear bucket portion into the concave room. A movable hammer member, an air inlet valve for activating the hammer member and a hole communicating the air inlet channel to the air inlet valve are disposed in the inner tube shell. An air room is formed between the bottom wall and an end wall of the inner tube shell. A communicating channel communicates the air inlet channel to the air room for air with high pressure entering the air room.

4 Claims, 4 Drawing Sheets

(56) References Cited

U.S. PATENT DOCUMENTS 3,635,605 A 1/1972 Hall et al.
3,666,027 A * 5/1972 Sauerwein ..... B23B 45/04 173/169
3,727,700 A 4/1973 Antsberg
4,355,564 A 10/1982 Gidlund
4,388,972 A * 6/1983 Gidlund ..... B25D 17/245 92/85 B
4,460,051 A 7/1984 Widmer
4,723,610 A 2/1988 Dummermuth
4,776,408 A 10/1988 Elkin et al.
4,867,366 A 9/1989 Kieinholz
5,083,619 A 1/1992 Giardino et al.
5,251,367 A 10/1993 Ward et al.
5,533,579 A 7/1996 Chu
5,575,051 A 11/1996 Moore
5,715,986 A 2/1998 Sauer
5,913,370 A * 6/1999 Chapelle ..... B25B 21/00 173/218
6,161,628 A * 12/2000 Liu ..... B25D 9/20 173/206
6,192,997 B1 * 2/2001 Tsai ..... B25D 9/18 173/210
6,668,942 B1 12/2003 Lin
6,763,990 B2 7/2004 Lee
7,013,986 B2 3/2006 Mikiya et al.
7,413,030 B2 8/2008 Chen et al.
8,196,675 B2 6/2012 Chang
8,240,394 B2 8/2012 Kobayashi
8,613,327 B2 12/2013 Johansson
9,844,867 B2 * 12/2017 Hsieh ..... B25D 17/24
10,792,798 B2 10/2020 Liaw
2007/0215370 A1 9/2007 Chen
2007/0295523 A1 * 12/2007 Chen ..... B25D 9/08 173/128
2017/0106519 A1 4/2017 Hsieh
2017/0305006 A1 10/2017 Watanabe
2018/0200874 A1 * 7/2018 Lin ..... B25D 9/04

* cited by examiner

VIBRATION REDUCING STRUCTURE OF PNEUMATIC HAMMER

This Application is being filed as a Continuation-in-Part application of Ser. No. 16/901,788, filed Jun. 15, 2020, currently pending, which was filed as a Continuation-in-Part of application Ser. No. 16/784,770, filed Feb. 7, 2020, currently pending.

BACKGROUND OF THE INVENTION

1. Technical Field

The present invention relates to a pneumatic hammer and more particularly to a vibration reducing structure of pneumatic hammer.

2. Description of Related Art

Vibration is generated in the course of using a pneumatic hammer due to the reciprocating movement of the hammer member, which has a bad effect upon user's hand that grasps the pneumatic hammer. In light of this, referring to FIG. 4, a space 83 with an elastic rubber chunk 84 and a spring 85 is disposed behind of a tube portion 82. The rubber chunk 84 and the spring 85 both abut against the tube portion 82. When the hammer member 81 moves backward and causes the tube portion 82 to vibrate, the rubber chunk 84 and the spring 85 are both compressed so that the vibration can be reduced.

The hammer member 81, however, acts up to several thousand times per minute, that is, the rubber chunk 84 has to bear the deformations several thousand times in one minute. Owing to the nature limitation of rubber material, the deformed rubber chunk 84 fails to restore original size so quickly before suffering next compression so as to lower the effect upon vibration reducing. In addition, such a high-frequency movement of the hammer member 81 will fatigue the rubber chunk 84 to lose its elasticity, not capable of taking effect upon vibration reducing anymore.

A conventional pneumatic hammer disclosed in U.S. Pat. No. 6,192,997B1 includes a space with a spring located behind a tube portion where a hammer member is provided. A vent hole, however, is disposed on a housing to communicate the space to environment so that the air in the space is not able to support the tube portion because the air will be squeezed out of the space when the hammer member moves backward. Although the vibration can be reduced by the spring, the spring, however, fails to restore original length so quickly before suffering next compression so as to lower the effect upon vibration reducing.

Another conventional pneumatic hammer disclosed in U.S. Pat. No. 4,388,972 includes a valve chamber with a valve member and a spring located behind a tube portion where a hammer member is provided. The valve housing includes an air inlet channel to communicate the valve chamber with a high pressure air supplier and an air outlet channel to communicate the valve chamber to environment. When the hammer member pushes the valve member backward to a back position, the valve member closes the air outlet channel and opens the air inlet channel for high pressure air entering the valve chamber to support the valve member. Further when the hammer member is pushed forward by the spring, the valve member closes the air inlet channel and opens the air outlet channel so that high pressure air is stopped entering the valve chamber while air in the valve chamber exhausts. According to this, the reciprocating movement of the valve member generates intermittent support for the valve member to reduce vibration. Since the support for the valve member does not always exist due to the valve chamber being not always filled up with high pressure air, it asks too high technical requirement for manufacturing of the structure to lose control precision so easily that the valve member does not obtain enough support. Moreover, there are several bends on both the air inlet channel and the air outlet channel, which hinders the air from smoothly flowing.

One more conventional pneumatic hammer disclosed in U.S. Pat. No. 2,120,992 includes several bends on the air channels so that flow rate of high pressure air is lowered. Work efficiency of this pneumatic hammer is limited.

BRIEF SUMMARY OF THE INVENTION

The primary objective of the present invention is to provide a pneumatic hammer having an air room that is always filled up with high pressure air for reducing vibration in the course of the hammer action, never losing the effort of vibration reducing due to elastic fatigue.

To achieve the above objective, the present invention provides a vibration reducing structure of pneumatic hammer including a handle having a concave room with an opening end and a bottom wall. The handle has an air inlet channel communicating with the concave room. The air inlet channel is provided with a control valve for controlling air to pass through. An outer tube shell is coupled with the opening end of the concave room while a movable inner tube shell is accommodated in the outer tube shell with a front tube portion and a rear bucket portion extending into the concave room. A movable hammer member, an air inlet valve for activating the hammer member and a hole communicating the air inlet channel to the air inlet valve are disposed in the inner tube shell. An air room is formed between the bottom wall and an end wall of the rear bucket portion. A sealing ring is provided at the rear bucket portion to closely connect with the concave room to seal the air room. A communicating channel communicates the air inlet channel to the air room for air with high pressure entering the air room.

A communicating channel is formed by drilling in a straight direction with no bend on a front side of the handle. A drilled opening formed on the front side of the handle is sealed with a sealing block. The communicating channel is inclined with respect to a moving direction of the hammer member and connects to a bottom surface of the air room. An anterior interface and a posterior interface are formed on the air inlet channel where the communicating channel interconnects. A position of the anterior interface is lower than that of the posterior interface. Each of the anterior interface and the posterior interface is located at an upstream position before the control valve so that high pressure air always enters the air room without control of the control valve. The air room is not in communication with an environment except for the communicating channel.

Preferably, a wear-resisting ring is disposed around the rear bucket portion to abut against the concave room.

An elastic supporting member abutting against the end wall is disposed in the air room. Preferably, the elastic supporting member is a spring.

DETAILED DESCRIPTION OF THE INVENTION

Figure 1:
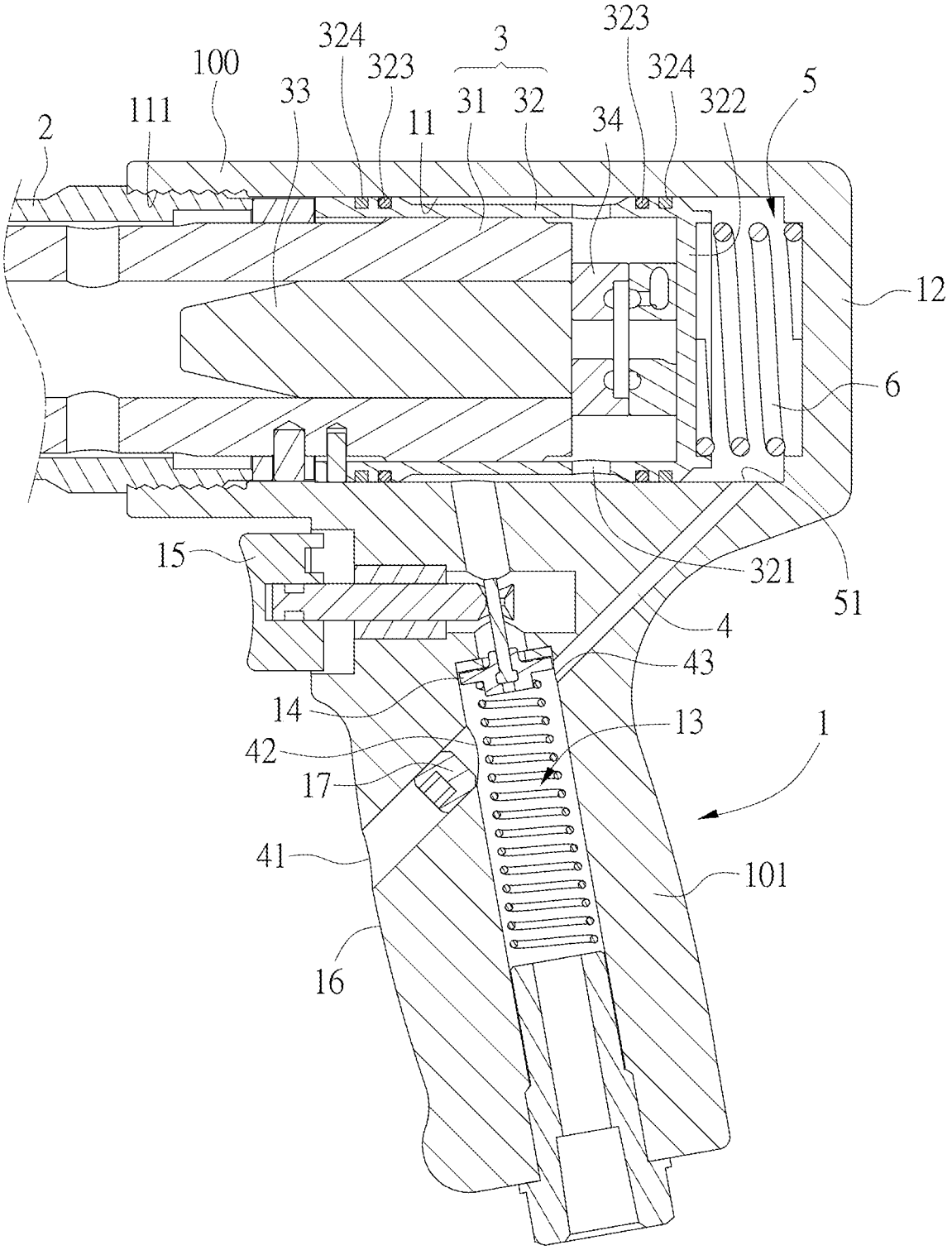
FIG. 1 is a sectional view of the present invention.

Referring to FIG. 1, the vibration reducing structure of pneumatic hammer according to the present invention includes a gun-shaped handle 1, an outer tube shell 2, an inner tube shell 3 and a communicating channel 4. A top portion 100 of the handle 1 is provided with a concave room 11 having an opening end 111 and a bottom wall 12. A bottom portion 101 of the handle 1 is provided with an air inlet channel 13 extending at an angle and communicating with the concave room 11 for connecting with an external high pressure air supply device. A control valve 14 is disposed in the air inlet channel 13 for controlling air to pass through. The control valve 14 can be operated by a button 15 located on the handle 1.

The outer tube shell 2 is coupled with the opening end 111 of the concave room 11 through threads. The inner tube shell 3 is movably accommodated in the outer tube shell 2. The inner tube shell 3 includes a front tube portion 31 with a movable hammer member 33, a rear bucket portion 32 with an air inlet valve 34 and a hole 321 provided at a side of the rear bucket portion 32 to communicate the air inlet channel 13 and the air inlet valve 34. According to this, after entering the concave room 11 through the air inlet channel 13, high pressure air passes through the hole 321 to enter the rear bucket portion 32 and then is injected into the tube portion 31 by the air inlet valve 34 for activating the hammer member 33 to move back and forth.

An end wall 322 is disposed at the rear end of the inner tube shell 3, more particularly on the rear bucket portion 32. An air room 5 is formed between the bottom wall 12 and the end wall 322. A sealing ring 323 surrounds the rear bucket portion 32 and closely connects with the concave room 11 so as to seal gaps between the rear bucket portion 32 and the concave room 11. A wear-resisting ring 324 surrounds the rear bucket portion 32 and closely connects with the concave room 11 so as to reduce wear therebetween during vibration. A spring 6 is provided in the air room 5 to abut against the end wall 322 for supporting the rear bucket portion 32.

Figure 2:
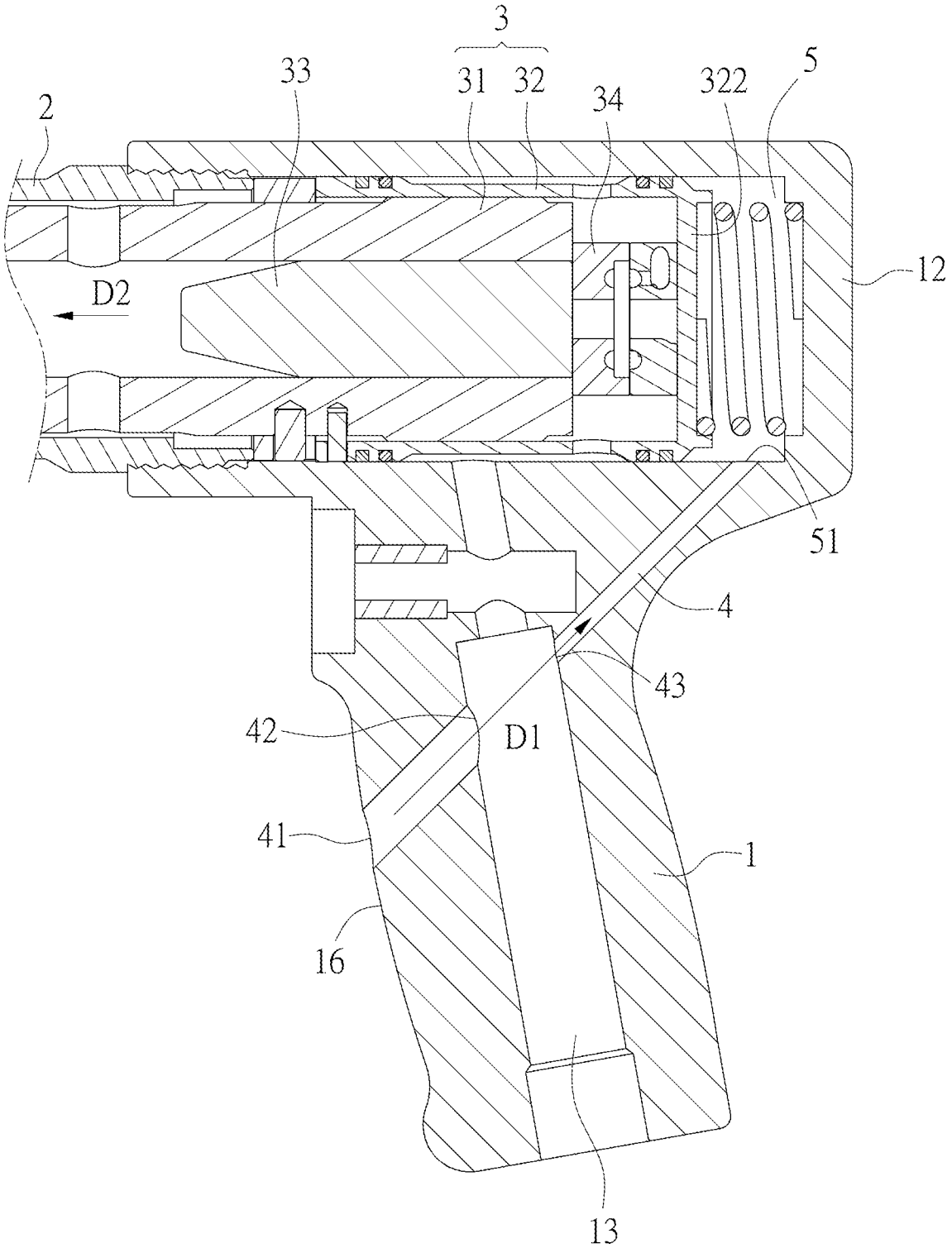
FIG. 2 is a sectional view of the present invention which removes the components disposed in the channels.

As shown in FIG. 1 and FIG. 2, by drilling in a straight direction D1 with no bend on a front side 16 of the handle 1 toward the air inlet channel 13 and the air room 5, a communicating channel 4 is formed. A drilled opening 41 is sealed with a sealing block 17. The communicating channel 4 is inclined with respect to a moving direction D2 of the hammer member 33. The communicating channel 4 connects to a bottom surface 51 of the air room 5 so that high pressure air entering the air room 5 via the communicating channel 4 after being guided into the air inlet channel 13. In this embodiment, two interfaces, defined as an anterior interface 42 and a posterior interface 43, are formed as a result of interconnection between the air inlet channel 13 and the communicating channel 4. A position of the anterior interface 42 is lower than that of the posterior interface 43. Each of the anterior interface 42 and the posterior interface 43 is located at an upstream position before the control valve 14 so that high pressure air can normally enter the air room 5, not depending on a pressing operation to the button 15 to open the control valve 14.

Since the communicating channel 4 made by drilling is straight, with no bend, high pressure air is guided into the air room 5 in a direct path, which avoids high pressure air from decreasing its velocity due to the bending of the path and further leads to pressure drop in the air room 5. Moreover, drilling is an easy way to form the communicating channel 4.

Figure 3:
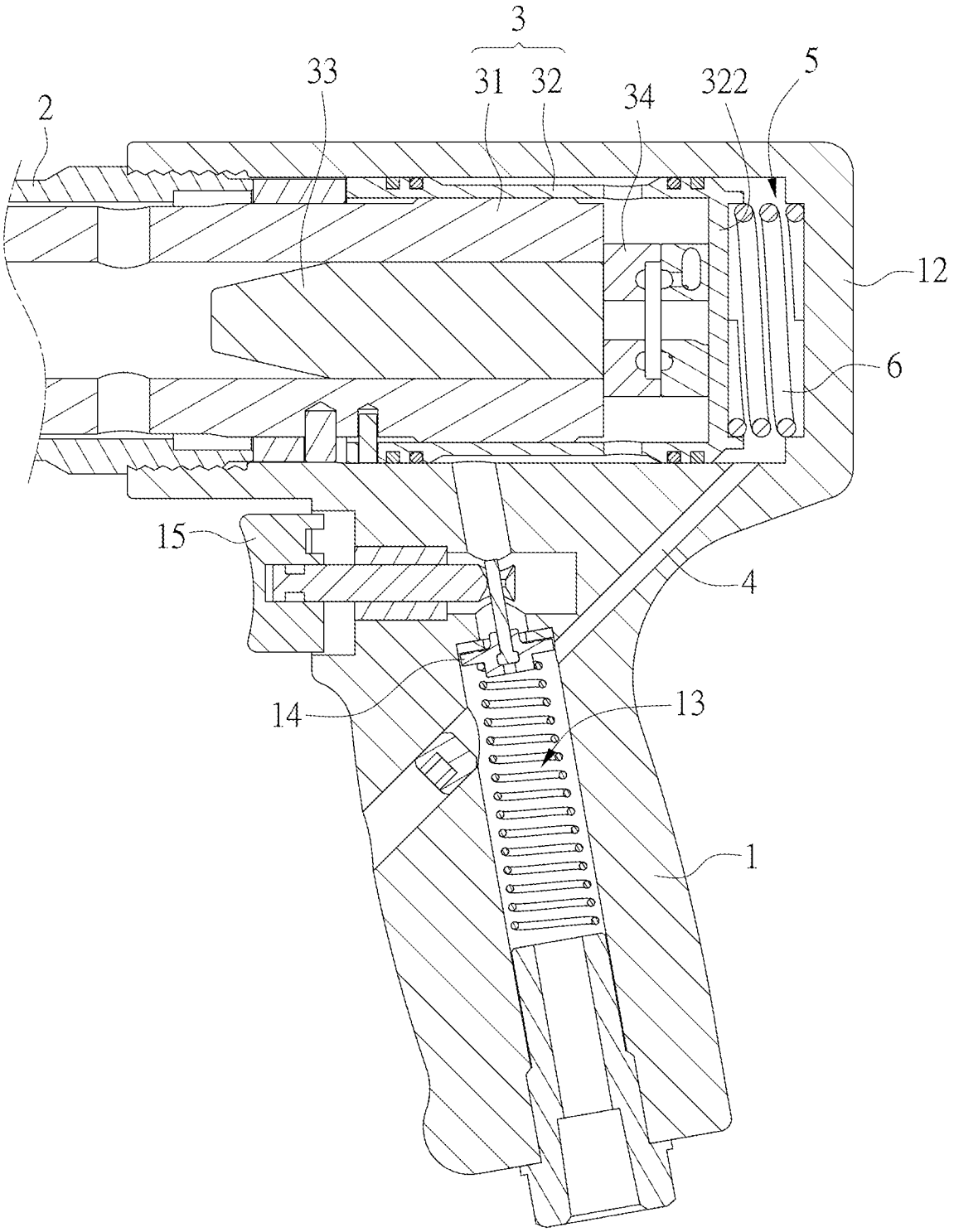
FIG. 3 is a sectional view showing the movement in use of the present invention.
Figure 4:
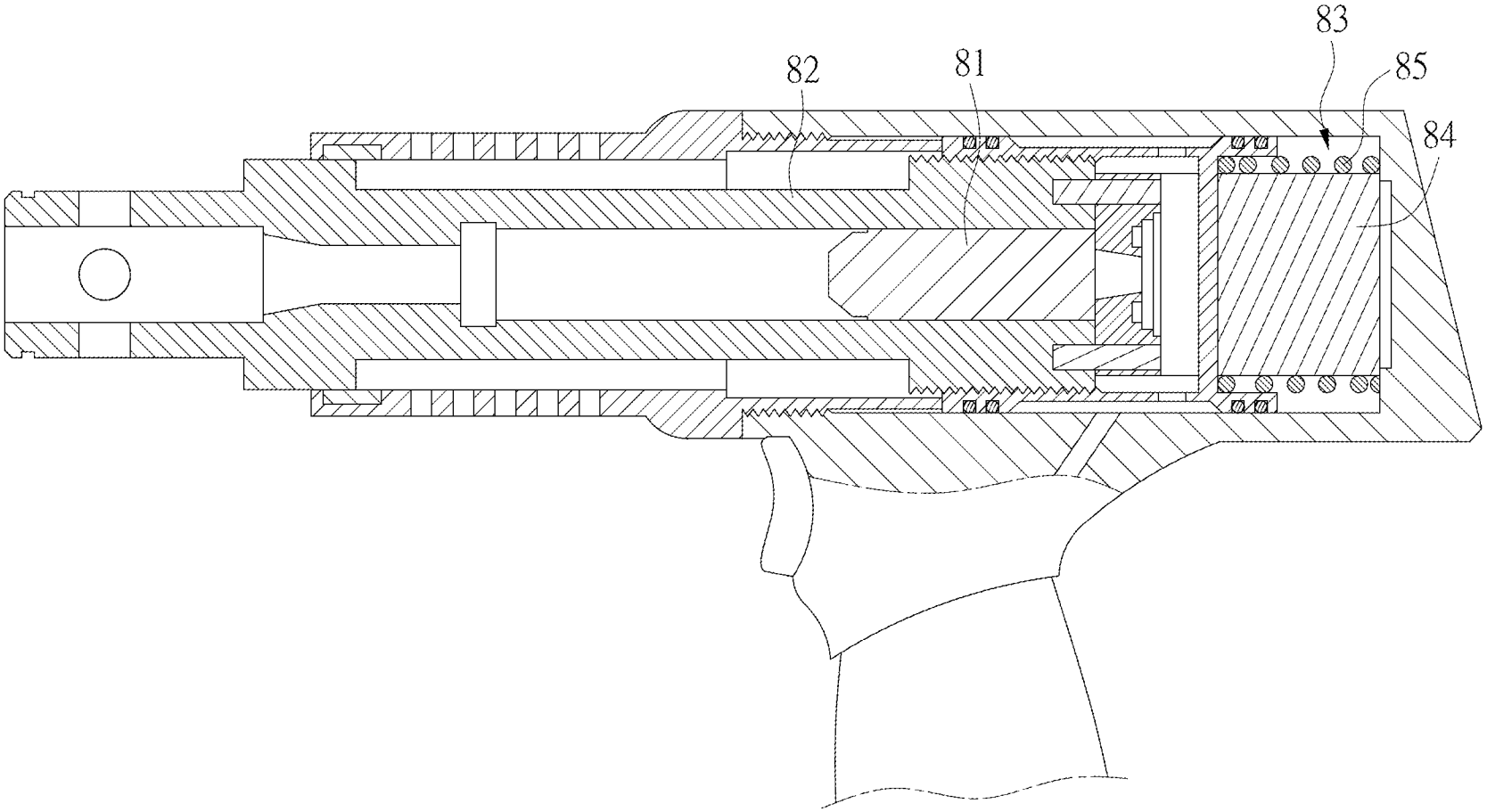
FIG. 4 PRIOR ART
FIG. 4 is a sectional view of a conventional pneumatic hammer.

According to the air room 5 being not in communication with environment except for the communicating channel 4, high pressure air normally injected into the air room 5 via the communicating channel 4 is not exhausted. Therefore, pressure in the air room 5 is kept greater than that in the environment so as to be able to be used to resist vibration generated in the course of the hammer member 33 action. As shown in FIG. 3, when the hammer member 33 moves backward and causes the inner tube shell 3 to vibrate, the air in the air room 5 supports the inner tube shell 3 as a result of its high pressure. The high pressure air in the air room 5 suffers compression from the hammer member 33 several thousand times per minute, but even so it is able to restore quickly and immediately, therefore taking effect in supporting the inner tube shell 3. On the other hand, there is no shaking, as hard bodies hit each other, when air suffers compression since air is formless material. In addition, the spring 6 also supports the inner tube shell 3, which is in cooperation to reduce the vibration.

Moreover, the air room 5 is filled with high pressure air so that the air functions on the whole area of the end wall 322 uniformly to take the best effect upon vibration reducing. The present invention uses formless high pressure air instead of elastic body, like rubber chunk, etc., to reduce vibration of the inner tube shell 3, avoiding from elastic fatigue caused by high-frequency vibration to ensure its durability.

Even though higher pressure air can work the pneumatic hammer better, it causes more violent vibration. In the present invention, however, air used for being injected into the air room 5 to reduce vibration comes from the same source of that used for driving pneumatic hammer, obtaining good effect upon vibration reducing and pneumatic hammer driving in the meantime. Dilemma of upgrading working efficiency or reducing vibration is dispelled.

What is claimed is:

1. A vibration reducing structure of pneumatic hammer comprising:

a handle having a top portion and a bottom portion, the top portion being provided with a concave room having an opening end and a bottom wall, the bottom portion being provided with an air inlet channel extending at an angle to communicate with the concave room, the air inlet channel being provided with a control valve for controlling air to pass through;

an outer tube shell coupled with the opening end of the concave room;

a movable inner tube shell accommodated in the outer tube shell, the inner tube shell with a front tube portion and a rear bucket portion extending into the concave room, wherein the front tube portion is provided with a movable hammer member, the rear bucket portion is provided with an air inlet valve for activating the hammer member and a hole communicating the air inlet channel to the air inlet valve;

an air room formed between the bottom wall and an end wall of the rear bucket portion, wherein a sealing ring is provided on the rear bucket portion to closely connect with the concave room; and a communicating channel formed in a straight direction with no bend on a front side of the handle, a drilled opening formed on the front side of the handle being sealed with a sealing block, the communicating channel being inclined with respect to a moving direction of the hammer member and connected to a bottom surface of the air room, an anterior interface and a posterior interface are defined on the air inlet channel where the communicating channel interconnects, wherein a position of the anterior interface is lower than that of the posterior interface, and each of the anterior interface and the posterior interface is located at an upstream position before the control valve so that high pressure air always enters the air room without control of the control valve, wherein the air room is not in communication with an environment except for the communicating channel.

2. The vibration reducing structure of pneumatic hammer of claim 1, wherein a wear-resisting ring is disposed around the rear bucket portion to abut against the concave room.

3. The vibration reducing structure of pneumatic hammer of claim 1, wherein an elastic supporting member abutting against the end wall is disposed in the air room.

4. The vibration reducing structure of pneumatic hammer of claim 3, wherein the elastic supporting member is a spring.

* * * * *